US005417586A

United States Patent [19]

Endo et al.

[11] Patent Number: 5,417,586

[45] Date of Patent: May 23, 1995

[54] FITTING DETECTION CONNECTOR

[75] Inventors: Takayoshi Endo; Sakai Yagi; Masanori Tsuji; Motohisa Kashiyama, all of Shizuoka, Japan

[73] Assignee: Yazaki Corporation, Tokyo, Japan

[21] Appl. No.: 229,333

[22] Filed: Apr. 12, 1994

[30] Foreign Application Priority Data

| | | | |
|---|---|---|---|
| Apr. 14, 1993 | [JP] | Japan | 5-018985 U |
| Jul. 8, 1993 | [JP] | Japan | 5-037371 U |
| Jul. 13, 1993 | [JP] | Japan | 5-038330 U |
| Jul. 13, 1993 | [JP] | Japan | 5-038331 U |

[51] Int. Cl.[6] ..... H01R 3/00

[52] U.S. Cl. ..... 439/489; 439/353

[58] Field of Search ..... 439/188, 488, 489, 490, 439/350, 353, 357, 507; 200/51 R, 51.09, 51.1

[56] References Cited

U.S. PATENT DOCUMENTS

| | | | |
|---|---|---|---|
| 5,112,246 | 5/1992 | Kawase et al. | 439/489 |
| 5,174,786 | 12/1992 | Kato et al. | 439/489 |

FOREIGN PATENT DOCUMENTS

| | | |
|---|---|---|
| 61-186180 | 11/1986 | Japan . |
| 3-82574 | 8/1991 | Japan . |
| 4-3419 | 2/1992 | Japan . |

*Primary Examiner*—Khiem Nguyen

*Attorney, Agent, or Firm*—Armstrong, Westerman, Hattori, McLeland & Naughton

[57] ABSTRACT

One connector housing includes a resilient locking arm having a through-hole provided at its tip, a pair of detection terminals attached to said resilient locking arm and opposed to the through-hole, a first spring portion provided on the side of a warping space of the resilient locking arm and inserted between the resilient locking arm and the pair of detection terminals, the first spring portion having a protrusion to be engaged in said through-hole so as to force the locking arm in an anti-warping direction, and a second spring portion always forcing said resilient locking arm in the anti-warping direction. Another connector housing includes an engagement protrusion which is to be engaged in the through-hole to push the protrusion, thereby warping the first spring portion in an anti-forcing direction to be brought into contact with the pair of detection terminals. Thus, connector fitting of one and another connector housings can be surely detected electrically. The fitting detection connector can have a buffer spring member which is arranged between the contact portion and intrusion protrusion of the first spring portion.

16 Claims, 10 Drawing Sheets

FIG. 16
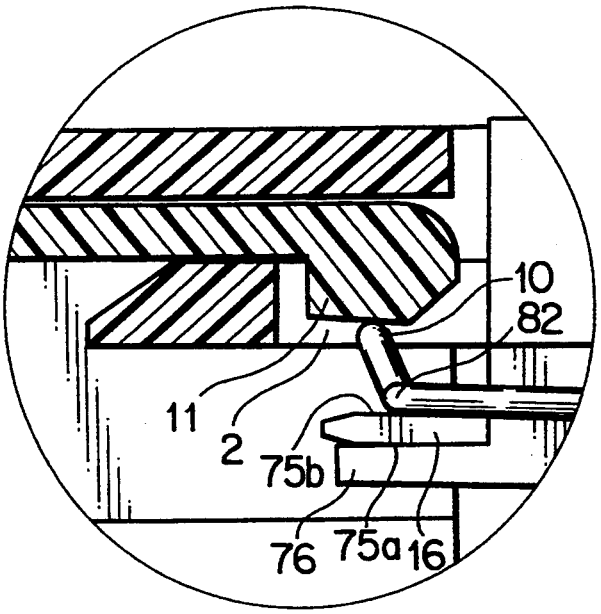
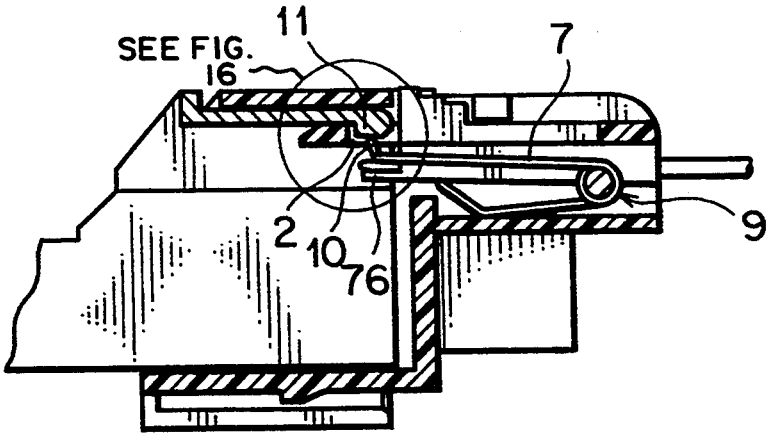
FIG. 16A

FITTING DETECTION CONNECTOR

BACKGROUND OF THE INVENTION

1. Field of the Invention

The present invention relates to a fitting detection connector which can electrically detect whether female and male connector housings have been fit into each other. The present invention also relates to a detection contact spring structure and a detection terminal deformation preventing structure which are used for the above fitting detection connector.

2. Description of the Prior Art

FIGS. 17 and 18 show a conventional fitting detection connector disclosed in Japanese Utility Model Publication No. Hei 4-3419.

This connector 28 includes one connector housing 29 with a connector fitting detection portion 30 provided on its outside. A sub-housing 33 of insulating resin composed of a terminal chamber 31 and a contact member insertion portion 32 is attached to the exterior wall of the housing 29. A pair of detection terminals 34, 34 are incorporated in the chamber 31 so that the respective tip male tabs 35, 35 are projected in parallel from the sub-housing 33. A contact member 36 having an shape is inserted and locked in the insertion portion 32 and its contact springs 37, 38 having different heights are opposed to the respective male tabs 35, 35. As seen from FIG. 18, the tip 41 of a resilient locking arm 40 of the other connector housing 39 presses a non-contact side contact spring piece 37 as shown in a dotted line so that the above pair of male tabs 35, 35 are brought into contact with the pair of contact spring pieces 37, 38. Thus, the fitting in the connector 28 can be detected.

The above connector structure has a disadvantage that the connector 28 itself becomes large because the fitting detection portion 30 is projected from the outside of the connector housing 29. Further, when the resilient locking arm 40 sits on and is engaged with the protrusion 42 of the one housing 29, the restitutive force of the locking arm 40 is weakened so that the pressing force of the contact piece 37 becomes insufficient. For this reason, the detection of fitting may become uncertain.

JP-A (Laid-Open) Sho 61-186180 also discloses a conventional fitting detection connector, particularly a detection terminal deformation preventing structure. This structure has the same disadvantage as in the conventional fitting detection connector disclosed in JU-Publication No. Hei 4-3419.

SUMMARY OF THE INVENTION

A first object of the present invention is to provide a fitting detection connector which can surely detect connector fitting without increasing the volume of the connector itself and injuring the restitutive force of a resilient locking arm.

A second object of the present invention is to provide a fitting detection connector which can bring a contact spring member into contact with a detection terminal with sufficient contact pressure so as to enable sure fitting detection.

A third object of the present invention is to provide a detection terminal deformation preventing structure for a fitting detection connector which can prevent deformation of a detection terminal so as to enable sure fitting detection.

In order to attain the first object, in accordance with the first aspect of the present invention, there is provided a fitting-detection connector comprising: one connector housing including a resilient locking arm having a through-hole provided in its tip, a pair of detection terminals attached to said resilient locking arm and opposed to said through-hole, a first spring portion provided on the side of a warping space of said resilient locking arm and inserted between said resilient locking arm and said pair of detection terminals, said first spring portion having an intrusion protrusion engaged in said through-hole so as to force said locking arm in an anti-warping direction, and a second spring portion always forcing said resilient locking arm in the anti-warping direction; and another connector housing having an engagement protrusion which is engaged in said through-hole to push said intrusion protrusion, thereby warping said first spring portion in an anti-forcing direction to be brought into contact with said pair of detection terminals.

In connector fitting, an engagement protrusion of the other connector housing warps the resilient locking arm of one connector housing so that it is engaged into a through-hole. The engagement protrusion pushes and moves the protrusion of a first spring portion so that the first spring portion is brought into contact with a pair of detection terminals. Thus, the pair of terminals are short-circuited to make electrical connection. The first spring portion is pushed by the engagement protrusion so as to be released from the resilient locking arm. A second spring portion forces the locking arm in an anti-warping direction to give the restitutive force to locking arm.

In the structure in which the first spring is divided into a movable contact portion and a fixed contact portion, its intrusion protrusion is pushed by the engagement protrusion so as to bring the movable contact portion into contact with the one detection terminal and make an electrical connection with the other detection terminal through the second spring and fixed contact portion.

In accordance with the present invention, since the detection terminal for electrically detecting the connector fitting and the spring portion are located inside the resilient locking arm and on the side of the arm resilient space, a slim connector shape can be obtained. Since the first spring portion is pushed by not the resilient arm but by the rigid engagement protrusion of a partner connector housing to make a contact with the detection terminal, the reliability of the electrical detection can be improved. Even after the first spring portion is brought into contact with the detection terminal, the second spring forces the resilient arm in an anti-warping direction so that arm locking can be surely made.

In order to attain the second object of the present invention, in the fitting-detection connector according the first aspect of the present invention, in accordance with the second aspect, a buffer spring portion being is formed between the intrusion protrusion and a contact portion of the first spring portion.

In operation, at the time of connector fitting, the engagement protrusion of another connector housing intrudes into the through-hole of the resilient locking arm of one connector housing to push the intrusion protrusion of the detection contact spring member, thereby bringing the contact portion of said detection contact spring member into contact with the detection terminals. Then, the buffer spring portion of said detection contact spring member warps to absorb excessive pressing force of the engagement protrusion so that the contact portion is resiliently brought into contact with the detection terminals. This assures persistent electric contact, thus improving fitting detection in the connector. Further, the buffer spring portion absorbs the excessive pressing force of the engagement protrusion so that the deformation of the detection terminals can be prevented.

In order to attain the third object of the present invention, in accordance with the third aspect of the present invention, the fitting-detection connector can further includes a resilient plate protruding from the lower end of said resilient locking arm whereby said detection terminals are prevented from being deformed.

In operation, at the time of connector fitting, the engagement protrusion of the other connector housing is engaged in the through-hole of the resilient locking arm to push the protrusion of the spring member. Thus, the contact portion of said spring member is brought into contact with the pair of detection terminals. Now even if the pressing force of the engagement protrusion is large, when the detection terminals are pushed to warp, the resilient plate warps simultaneously to absorb excessive pressing force. This prevents the plastic deformation in the detection terminals and sure contact pressure. When the pressing force by the engagement protrusion is released, the detection terminals are restored to the original position owing to resiliency of said resilient plate. Since the pressing force by the engagement protrusion, i.e. contact pressure of a twisted coil spring and detection terminal can be set for a large value, thereby improving the reliability of electrical connection. Further, when the pressing force of the engagement protrusion is released, the resilient plate resiliently restores the detection terminals to their initial positions. This improves repetitive durability and enables sure fitting detection even when fitting and removal of the connector are carried out many times.

The above and other objects and features of the present invention will be more apparent from the following description taken in conjunction with the accompanying drawings.

BRIEF DESCRIPTION OF THE DRAWINGS

FIG. 16 is a longitudinal sectional view after fitting according to the present invention inclusive of a partially enlarged view of the main part within a circle;

DESCRIPTION OF THE PREFERRED EMBODIMENTS

Embodiment 1

Figure 1:
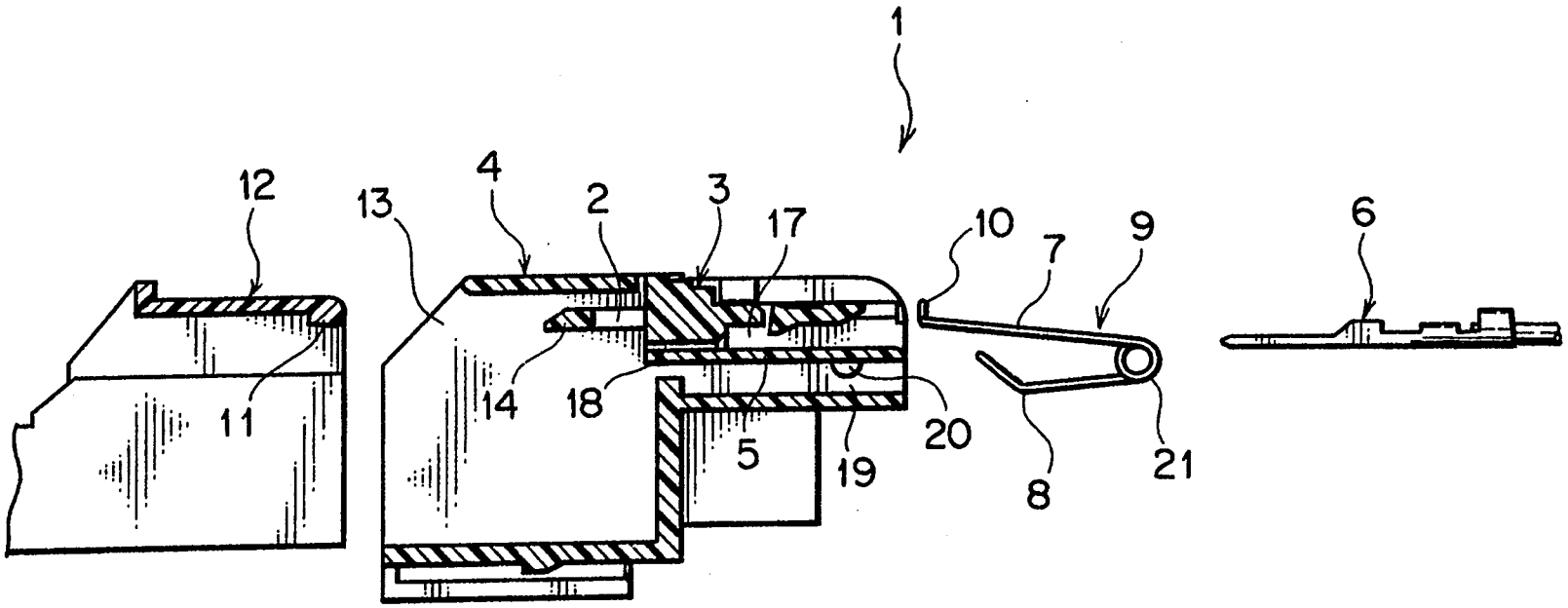
FIG. 1 is an exploded longitudinal sectional view showing one embodiment of a fitting detection connector according to the present invention.

FIGS. 1 to 5 show one embodiment of a fitting detection connector according to the present invention.

The fitting detection connector 1 is generally composed of a female connector housing 4 of insulating resin in which a resilient locking arm 3 having a through-hole at its tip is internally arranged; a pair of detection terminals to be mounted in the lower half of the resilient locking arm, a twisted coil spring member 9 having a pair of spring portions 7 and 8 for forcing the resilient locking arm 3 in an anti-warping direction, which is arranged on the side of resilient space of the resilient arm 3 within the female connector housing 4; and a male connector housing 12 having an engagement protrusion 11 for pressing the tip-side protrusion 10 of the one spring portion 7 engaged into tip-side through-hole 2 of the resilient arm 3.

Figure 2:
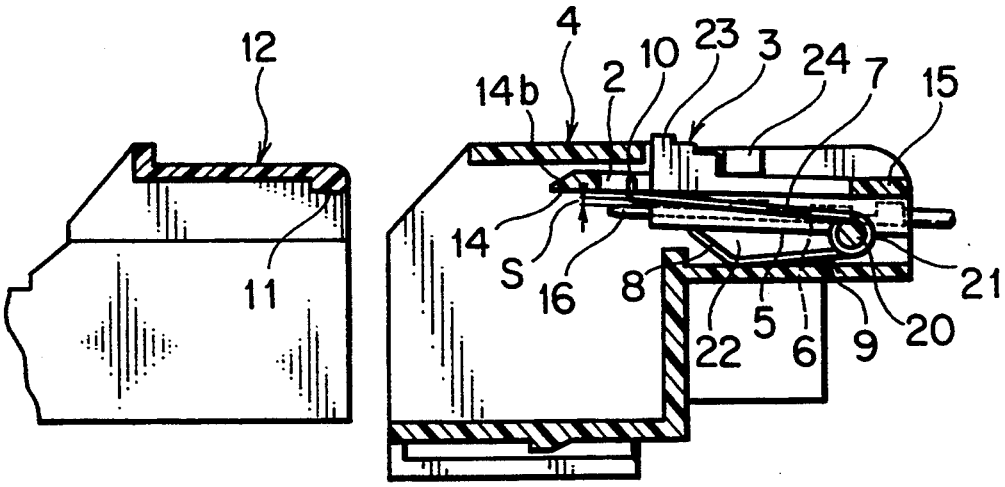
FIG. 2 is a longitudinal sectional view showing the state where a spring member and detection terminals are mounted in one connector housing in the one embodiment of the present invention.

The female connector housing 4 includes a partner connector fitting chamber 13 in its front part and the above resilient locking arm 3 in its rear and upper part. The resilient locking arm 3 protrudes the tip portion 14 having the through-hole 2 in the warping direction into the fitting chamber 13, and accommodates a pair of detection terminals 6, 6 in its rear half part stepwise-protruding from the tip portion 14 as shown in FIG. 2. The locking arm 3 can be warped up and down around a fulcrum portion 15 on the stem side. The tip male tab 16 of the detection terminal 6 is protruded from the terminal chamber 17 (FIG. 1) in the lower half portion 5 into the fitting chamber 13 through a through-hole 18 so that it is located opposedly to the lower side of the through-hole 2.

Further, a pair of fulcrums 20, 20 for the above twisted coil spring member 9 are protruded from both rear side walls 19, 19. The coil portion of the spring member 9 is engaged in the fulcrum 20 so that the spring member 9 is located in the warping space on the lower side of the resilient arm 3. The twisted coil spring member 9 has a first spring portion which is straight and relatively long on the upper side of the coil member 21 and a second spring portion 8 which is relatively short and bent in a "<" shape of on the lower side of the coil member 21.

Figure 5:
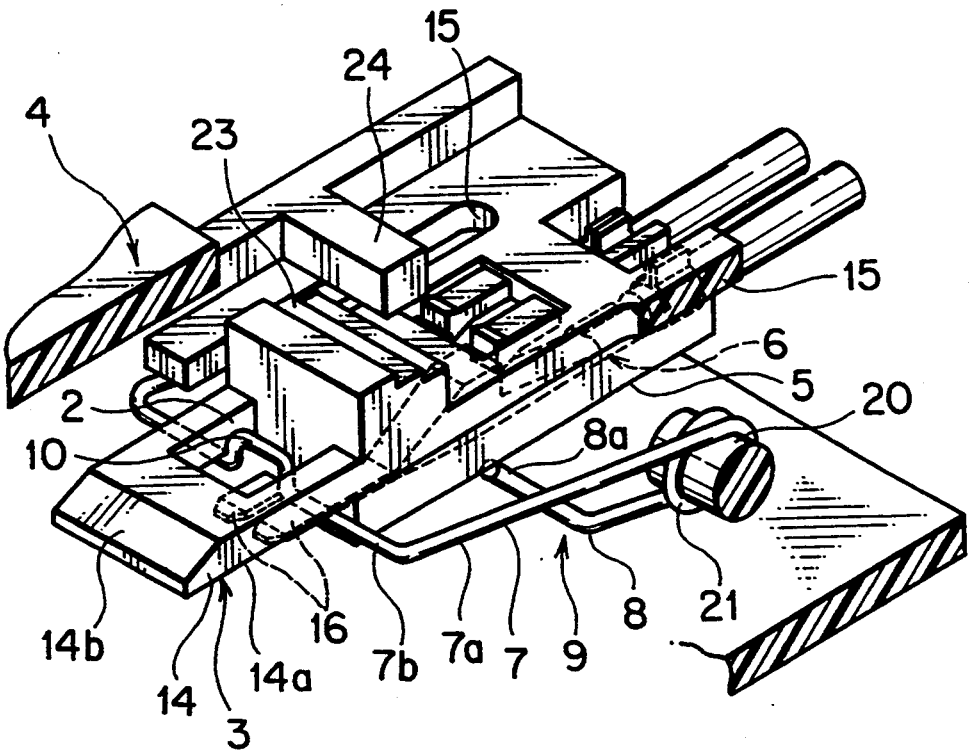
FIG. 5 is a perspective view showing the main part in the state of FIG. 2.

As seen from FIG. 5, the first spring portion 7 has a square shape of generally anti- and is composed of lengthy portions *7a, 7a* on both sides which extend in the longitudinal direction of the resilient arm 3 from the coil portion 21 and an orthogonal portion *7b* connects the tips of both lengthy portions *7a, 7a*. The orthogonal portion *7b* has the above protrusion 10 of a bent square shape which is formed at its central position and intrudes into the through-hole 2 of the resilient arm 3. The orthogonal portion *7b* is passed between the resilient locking arm 3 and the male tabs 16, 16 of the pair of the terminals 6, 6, and abuts on the lower surface 14*a* of the tip of the resilient arm 3 to force the locking arm 3 toward the anti-warping direction. The orthogonal portion *7b* of the first spring portion 7 is opposed to the male tab 16 in a non-contact state with a slight gap S (see FIG. 2).

The second spring portion 8 extends in a form bent in a "<" shape from the coil portion 21 to abut its tip 8*a* on the lower wall of he lower half portion (terminal chamber) of the resilient arm 3 so that the locking arm 3 is always forced in the anti-warping direction. The locking arm 3 has a removal pressing operation part 23 protruding in the rear of the through-hole 2. The rear of the removal pressing operation part 23 is abutted on the stopping protrusion 24 protruding in a crossing direction of the arm 3 from the female connector housing 4. The tip 14 of the locking arm is provided with an upward tapering guide 14*b* for inner engagement protrusion 11 at the tip of a partner connector housing 12.

Figure 3:
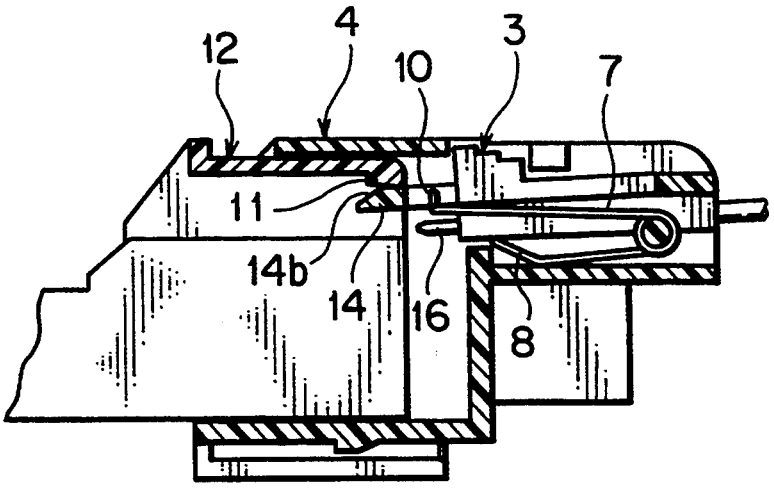
FIG. 3 is a longitudinal sectional view showing the state where connector fitting is being carried out.
Figure 4:
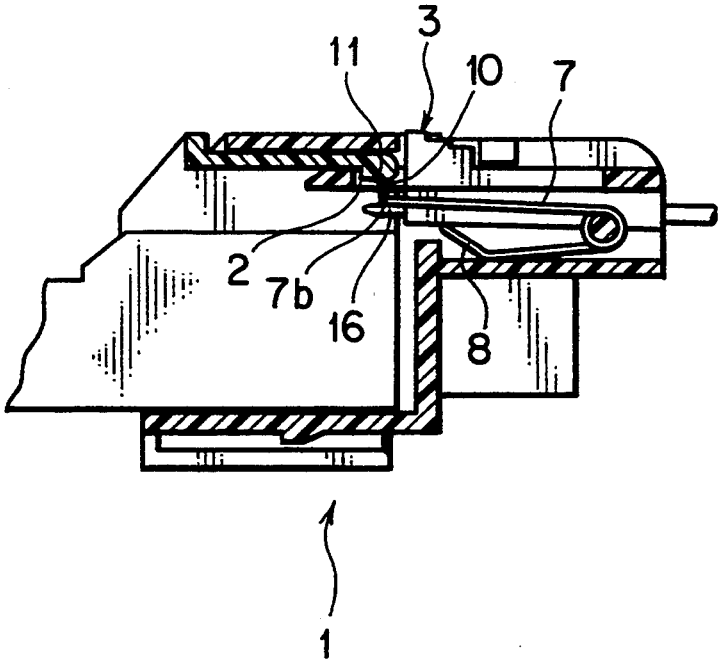
FIG. 4 is a longitudinal sectional view showing the state where the connector fitting has been completed.

As shown in FIG. 3, in connector fitting, the resilient locking arm 3 is pressed, in its tip 14, to the engagement protrusion 11 and warps downward against the spring forcing. As shown in FIG. 4, the resilient locking arm 3 is restored to its initial form when the engagement protrusion is engaged in the through-hole 2. The protrusion 10 of the first spring portion 7 located in the through-hole 2 is pushed by the engagement protrusion 11 to press down the first spring portion itself downwards. Thus, the orthogonal portion *7b* of the first spring portion 7 is brought into contact with the male tabs 16, 16 of the pair of detection terminals so that the fitting of the connector 1 is electrically detected.

Although the first spring portion 7 is pressed down by the engagement protrusion 11 so that the it becomes apart from the resilient arm 3, the second spring portion 8 always forces the arm 3 in a pressing-up direction. Thus, resilient locking of the resilient arm 3 can be assured. Further, since the engagement protrusion 11 which is not resilient but rigid presses down the first spring portion 7, electrical connection between the first spring portion 7 and the detection terminals 6, 6 can be assured.

Figure 6:
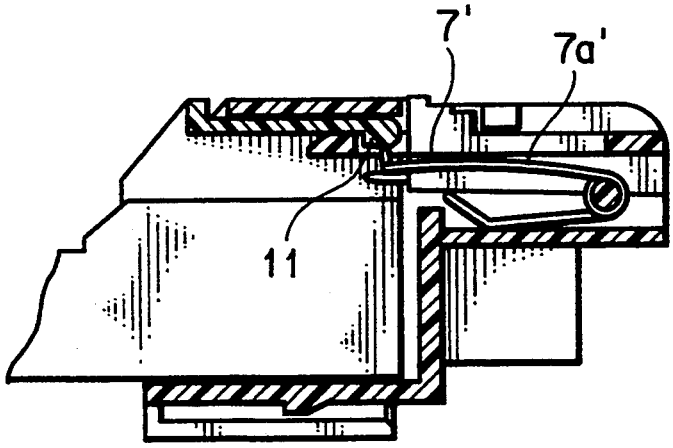
FIG. 6 is a longitudinal sectional view showing one modification of the above fitting detection connector.

Further, the longitudinal portion *7a'* of the first spring portion 7' may be bent in an arc shape as shown in FIG. 6. In this case, when such a longitudinal portion *7a'* is pressed down by the engagement protrusion 11, it will be further bent to absorb redundant pressing force. The stored spring force due to bending increases the restitutive force of the first spring portion 7', thus improving spring durability.

Embodiment 2

Figure 7:
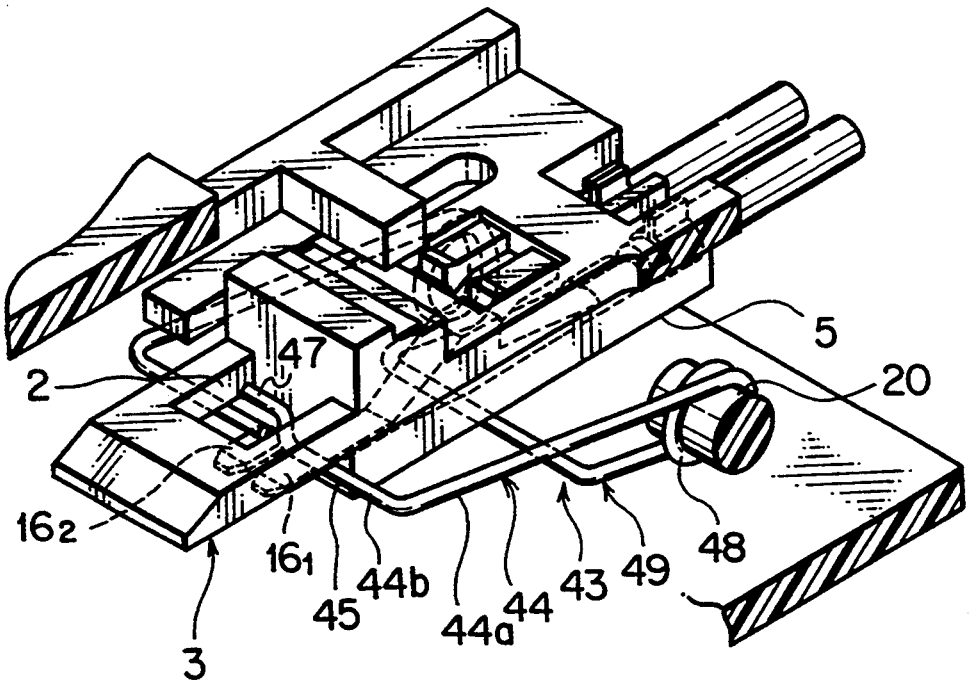
FIG. 7 is a perspective view showing the main part of the other embodiment of a fitting detection connector according to the present invention.
Figure 8:
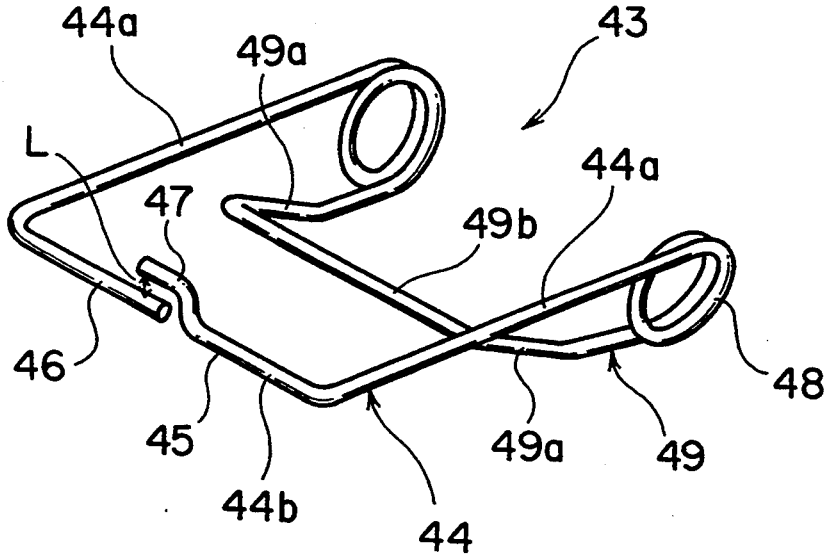
FIG. 8 is a perspective view showing the twisted coil spring member in the other embodiment of the present invention;..
Figure 9:
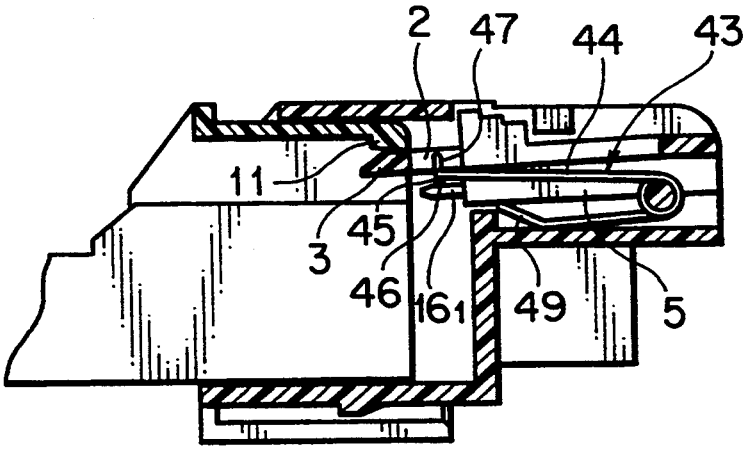
FIG. 9 is a longitudinal sectional view of the state where the connector fitting is being carried out in the other embodiment of the present invention.

FIGS. 7 to 9 show another embodiment of the fitting detection connector according to the present invention. FIG. 8 shows a twisted coil spring member 43 in this embodiment. As seen from FIG. 8, the front orthogonal portion 44*b* is divided into a movable contact portion 45 opposed to the first detection terminal 161 and a fixed contact portion 46 kept in contact with the other detection terminal $16_2$. A protrusion 47 engaged in the through-hole of the resilient locking arm 3 is formed integrally to the tip of the movable contact portion 45. The stems of a pair of longitudinal portions 44*a, 44a* having both contact portions 45 and 46 are connected to each other by a second spring portion having an anti-] shape which is successive to a coil portion 48 engaged with a fulcrum 20.

The second spring portion 49 is composed of a pair of longitudinal portions 49*a, 49a* each bent in a "<" shape and an orthogonal portion 49*b* which connects the pair of longitudinal portions 49*a, 49a* with each other and is in press-contact with the lower half portion 5 of the resilient arm 3. The movable contact portion 45 and the fixed contact portion 46 are separated by a gap L from each other in a free state. As shown in FIG. 9, in a state where the engagement protrusion 11 of a partner connector is engaged with the through-hole 2 of the resilient locking arm 3, the movable contact portion 45 is warped downward as a result that its protrusion 47 is pushed, thereby being brought into contact with the detection terminal $16_1$. Thus, the pair of detection terminals $16_1$ and $16_2$ become conductive through the twisted spring member 43 so that the connector fitting can be electrically detected.

Embodiment 3

Figure 10:
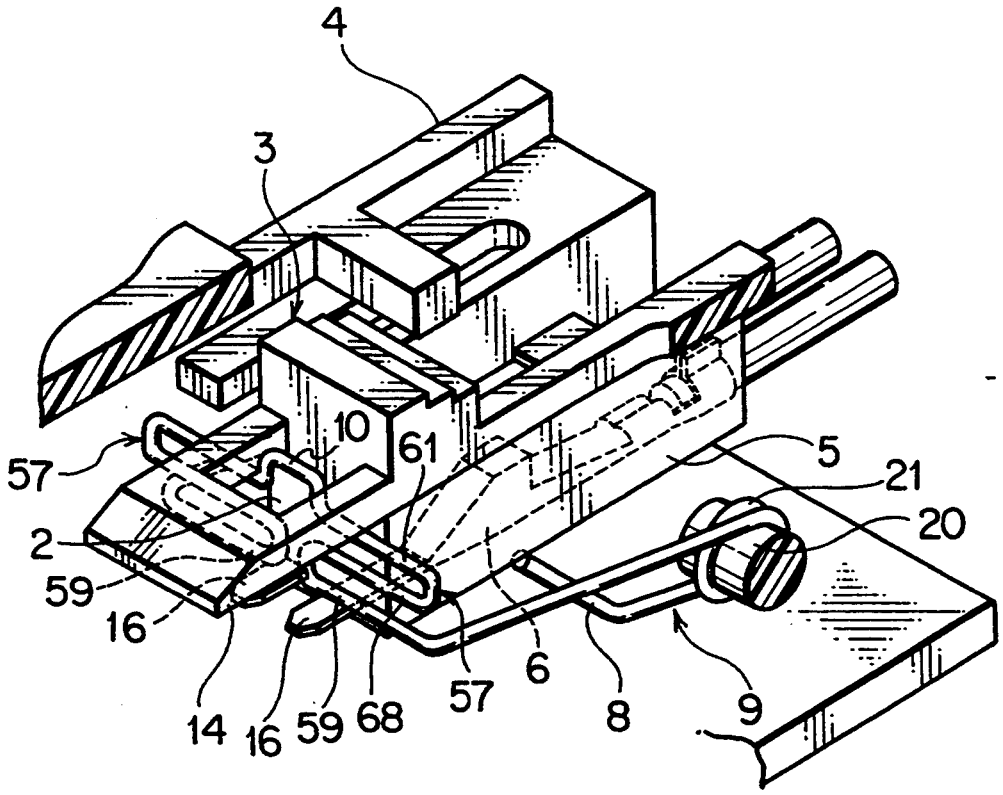
FIG. 10 is a perspective view showing one embodiment of the detection contact spring structure for a fitting detection connector according to the present invention.
Figure 11:
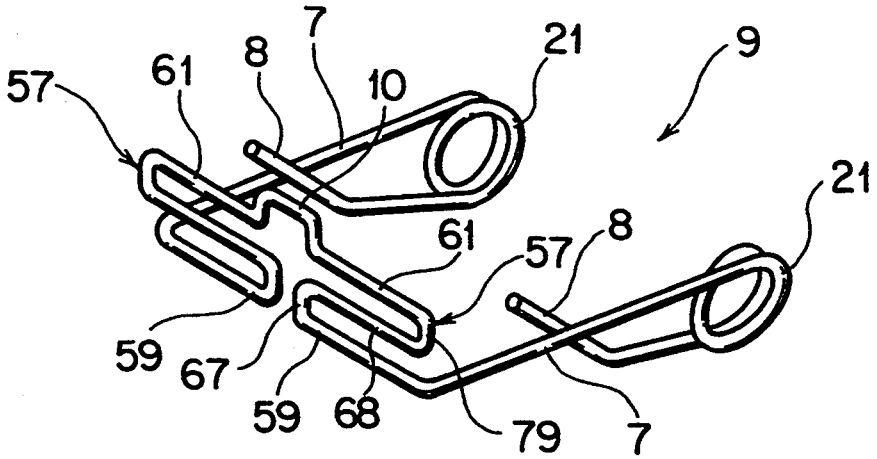
FIG. 11 is a perspective view showing a detection spring member used for the detection contact spring structure in FIG. 10.
Figure 12:
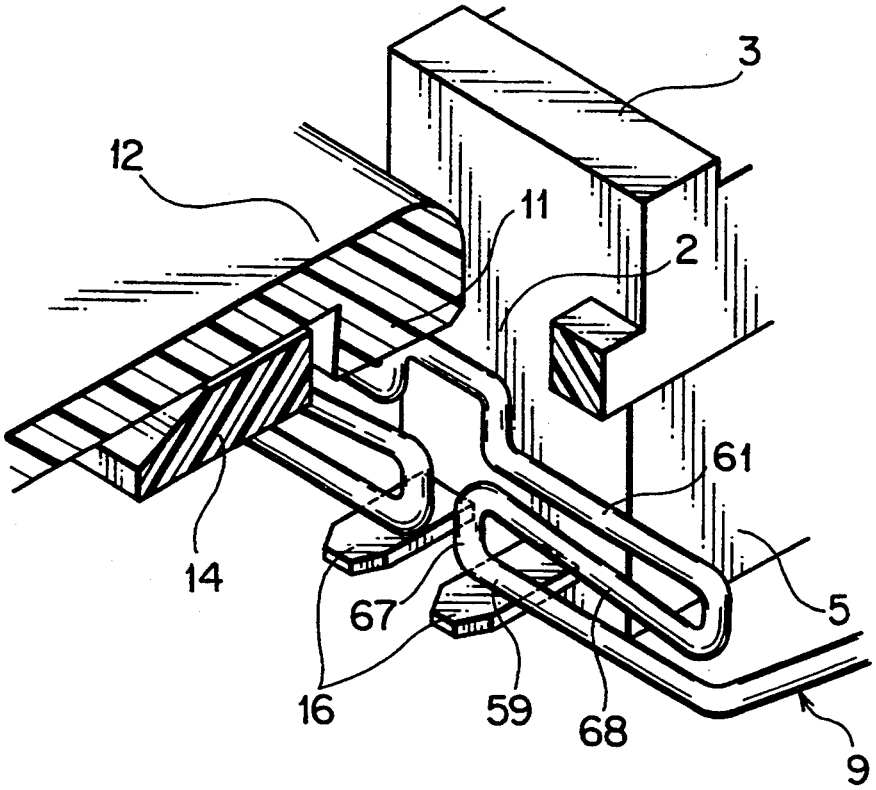
FIG. 12 is an enlarged perspective view showing a buffer spring portion of the detection contact spring member shown in FIG. 11.
Figure 13:
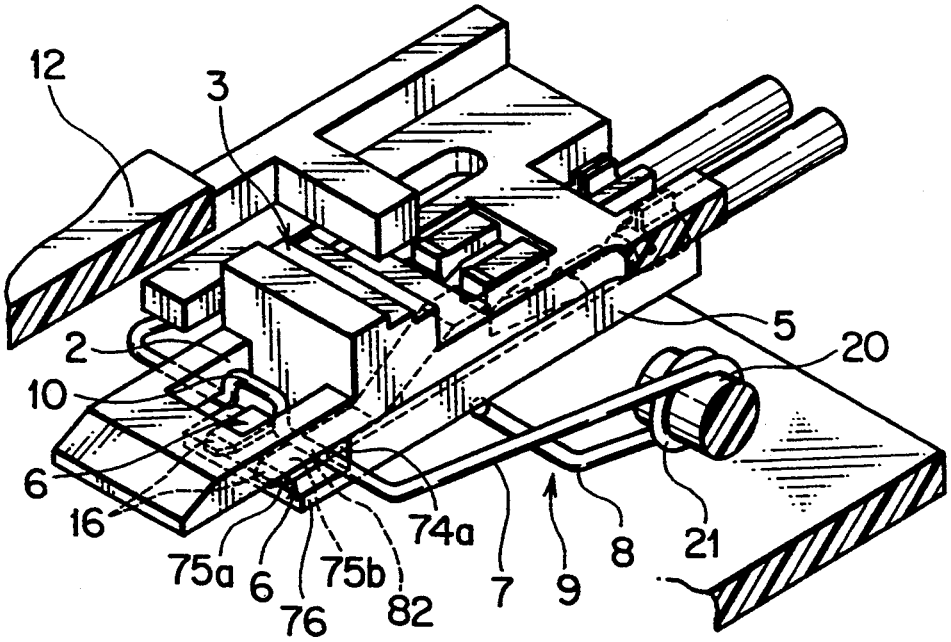
FIG. 13 is a perspective view showing the detection terminal deformation preventing structure for a fitting detection connector according to the present invention.
Figure 14:
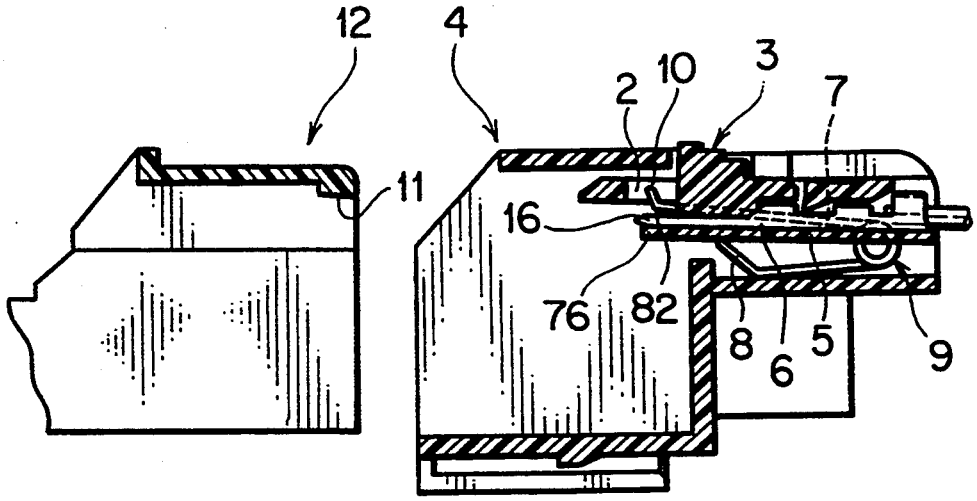
FIG. 14 is a longitudinal sectional view showing the state of a male and a female connector before fitting according to the present invention.

This embodiment is directed to a detection contact spring structure. FIGS. 10 to 12 show the detection contact spring structure for a fitting detection connector according to the present invention. In FIGS. 10 to 12, like reference numerals refer to like parts in FIGS. 1 to 7. This structure is characterized in that as a buffer spring structure 57 of a detection contact spring member 9 is arranged between a resilient locking arm 3 attached to one connector housing 4 and protruding male tabs 16, 16 of a pair of detection terminals 6, 6 attached on the lower half 5 of the resilient locking arm 3.

The detection contact spring member 9, as shown in FIG. 11, is composed of long spring portions 7, 7 left and right opposite to each other, contact portions 59, 59 corresponding to the pair of male tabs 16, 16 formed integrally and orthogonally to the long spring portions 7, 7 at their tips, buffer spring portions 57, 57 having an character Z shape which are formed toward the lower surface of the tip portion 14 of the resilient locking arm 3 from each of contact portions 59, 59, abutting portions 61, 61 integral to the upper portions of the buffer spring portions 57, 57, the abutting portions 61, 61 abutting on the tip portion 14 of the resilient locking arm 3, an intrusion protrusion 10 for a through-hole 2 of the tip portion 14, the intrusion portion 10 being formed at the center of the abutting portion 61, an engagement coil portion 21 for a supporting shaft 20 of the connector housing 4, the engagement coil portions 21 being formed at the stem of the long spring portions 7, and short spring portions 8, 8 which always force the lower half of the resilient arm 3 are integral to the engagement coil portions 21, 21. In the unfitting state of the connector, the contact portions 59, 59 are separated upwards from the male tabs 16, 16 and the abutting portions 61, 61 force the tip portion 14 of the resilient arm 3 in an anti-warping direction (upward).

Each of the buffer spring portions 57, 57, as shown in FIG. 11, is composed of an inner vertical portion 67 extending upwards from the inner end of the contact portion 59, a horizontal portion 68 outwardly extending in parallel to the contact portion 59 from the vertical portion 67, an outer vertical portion 69 extending from the outer end of the horizontal portion 68 to the abutting portion 61 and the abutting portion 61 in parallel to the horizontal portion 68. The buffer spring portions 57, 57 warp up and down at the time of connector fitting to absorb excessive pressing force of the engagement protrusion 11 of the other connector 12. Specifically, the abutting portion 61 and the horizontal portion 68 warp in opposite directions to absorb the pressing force to bring the detection contacts 59, 59 into resilient contact with the male tabs 16, 16. This assures contact pressure, thus preventing plastic deformation of the male tabs 16, 16 due to excessive pressing force.

Embodiment 4

This embodiment intends to provide a specific structure for preventing deformation of detection terminals for a fitting detection connector according to the present invention. The basic structure of the fitting detection connector used in this embodiment has been explained with reference to FIGS. 1 to 7.

As seen from FIGS. 13 to 16, in order to prevent plastic deformation of a pair of detection terminals 6, 6 and obtain their electrical contact at higher contact pressure, the structure according to this embodiment is characterized by a resilient plate 76 for reinforcement which is formed so as to protrude integrally from the lower half 5 of the resilient locking arm 3 and to be brought into intimate contact with the lower plate surfaces 75*a*, 75*a* of male tabs 16, 16 of the pair of detection terminals 6, 6.

The reinforcement resilient plate 76 is formed along the lower plate surfaces 75*a*, 75*a* of the male tabs 16, 16 so as to protrude the front edge 74*a* of the lower half 5 of the locking arm 3 with a length substantially equal to that of the male tabs 16, 16. The resilient plate 76 has a width which is slightly larger than that of the pair of detection terminals 6, 6. Namely, the resilient plate 76 protrudes slightly outwardly from the outer ends of the detection terminals 6, 6 in a horizontal direction. This intends to restrain the warping of the male tabs 16, 16 within a resilient range when the contact portion 82 of a twisted coil spring 76 pressed by the engagement protrusion 11 presses down the male tabs 16, 16 of the pair of detection terminals 6, 6. The reinforcement resilient plate 76 can warp integrally to the male tabs 16, 16 within the resilient limit of the male tabs 16, 16. When the fitting of the one and the other connector housings 4 and 12 is removed, the pressure by the engagement protrusion 11 is released so that the resilient plate 76 restores to an initial position simultaneously with the male tabs 16, 16 of the detection terminals 6, 6.

Figure 15:
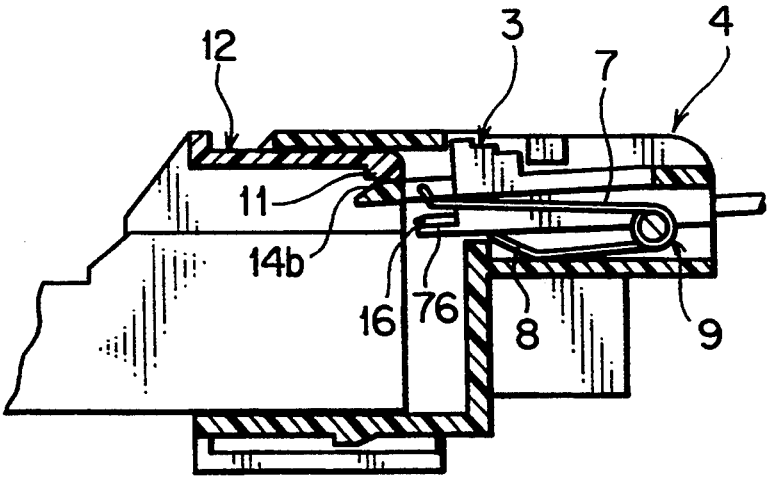
FIG. 15 is a longitudinal sectional view showing the state of a male and a female connector on the way of fitting according to the present invention.
Figure 17:
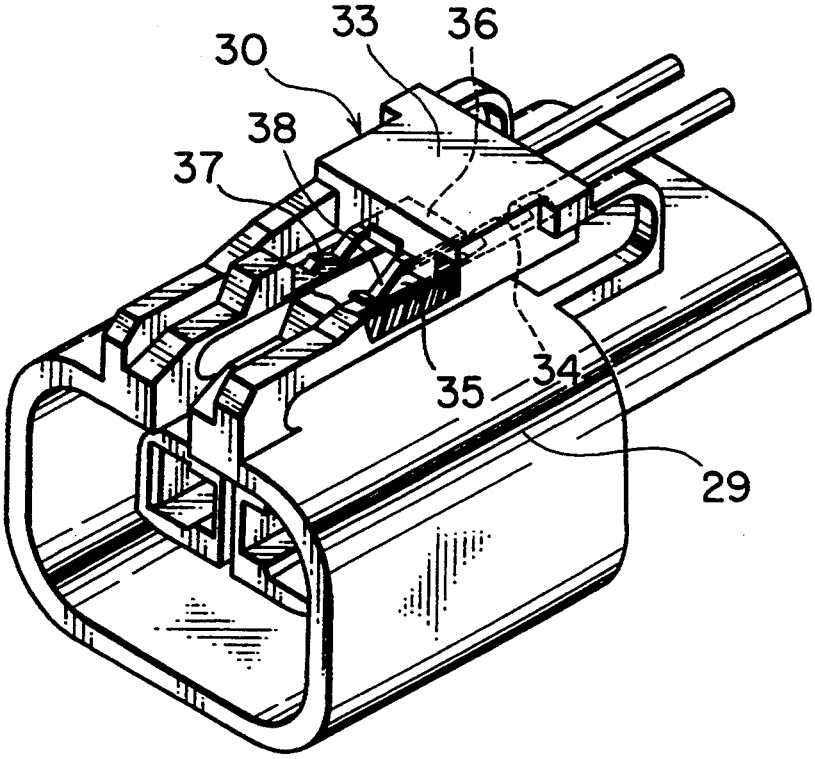
FIG. 17 PRIOR ART
FIG. 17 is a perspective view of the prior art.
Figure 18:
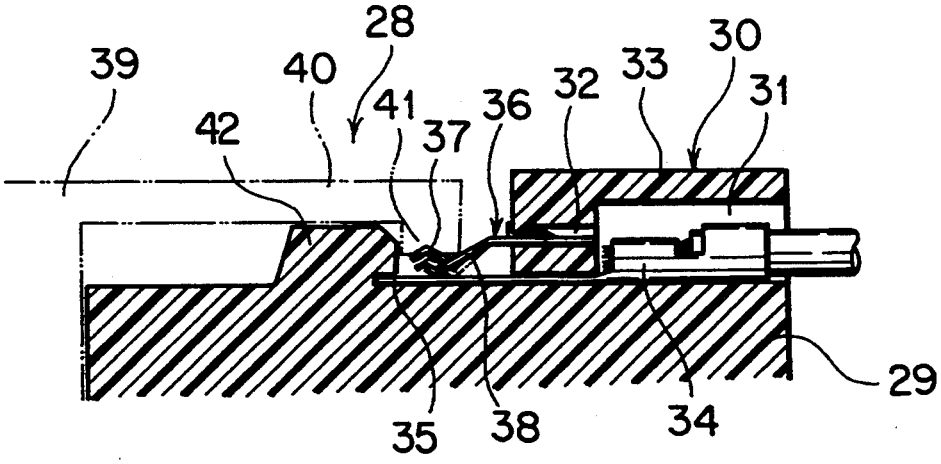
FIG. 18 PRIOR ART
FIG. 18 is a longitudinal sectional view of the main part of the prior art.

Specifically, as shown in FIG. 15, in fitting the male and female connectors 4 and 12, the engagement protrusion of the male connector housing 12 slides along the tip tapered face 14b of the resilient locking arm 3 to press down the resilient locking arm 3 against the force by a long spring portion 7 and a short spring portion 8. Then, as shown in FIG. 16, when fitting is completed, the engagement protrusion 11 presses down the intrusion protrusion 10 of the long spring portion 7 to bring the contact portion 82 of the long spring portion 7 into contact with the upper plate surfaces 75*b*, 75*b* of the male tabs 16, 16 of the pair of detection terminals 6, 6.

Now even if the pressing force by the engagement protrusion 11 is great, as seen from the enlarged view of FIG. 16, the resilient plate 76 warps integrally to the male tabs 16, 16 of the detection terminals 6, 6 to absorb weighting, thereby preventing the male tabs 16, 16 from being bent. Therefore, the contact pressure between the contact portion 82 of the coil spring 9 and the male tabs 16, 16 of the detection terminals 6, 6 can be set for a large value, thus assuring electric connection. Further, when the pressing force by the engagement protrusion 11 is released, the resilient plate 76 resiliently returns the male tabs 16, 16 to their original positions.

We claim:

1. A fitting-detection connector comprising:

one connector housing including a resilient locking arm having a through-hole provided at its tip, a pair of detection terminals attached to said resilient locking arm and opposed to said through-hole, a first spring portion provided on the side of a warping space of said resilient locking arm and inserted between said resilient locking arm and said pair of detection terminals, said first spring portion having a protrusion to be engaged in said through-hole so as to force said locking arm in an anti-warping direction, and a second spring portion always forcing said resilient locking arm in the anti-warping direction; and another connector housing having an engagement protrusion which is to be engaged in said through-hole to push said protrusion, thereby warping said first spring portion in an anti-forcing direction to be brought into contact with said pair of detection terminals.

2. A Fitting-detection connector according to claim 1, wherein said first spring portion and said second spring portion are integrated to constitute a twisted coil spring member.

3. A fitting-detection connector according to claim 1, where said first spring portion is composed of a movable contact portion having said protrusion which is opposed to said one detection terminal to force said resilient locking arm towards the anti-warping direction, and a fixed contact portion kept in contact with said other detection terminal, said movable contact portion and said fixed portion being successive to each other through said second spring portion.

4. A fitting-detection connector according to claim 2, where said first spring portion is composed of a movable contact portion having said protrusion which is opposed to said one detection terminal to force said resilient locking arm towards the anti-warping direction, and a fixed contact portion kept in contact with said other detection terminal, said movable contact portion and said fixed portion being successive to each other through said second spring portion.

5. A fitting-detection connector according to claim wherein said first spring portion has a pair of buffer spring portions integral to said intrusion protrusion.

6. A fitting-detection connector according to claim 2, wherein said first spring portion has a buffer spring portion.

7. A fitting-detection connector according to claim 5, wherein said buffer spring portion includes a pair of inner vertical portion extending upwards from the inner end of a contact portion to be in contact with the detection terminals, a pair of horizontal portions outwardly extending in parallel to the contact portions from the vertical portions, a pair of outer vertical portions extending from the outer ends of said horizontal portions to a pair of abutting portions in parallel to said horizontal portions, said abutting portions being integral to said intrusion protrusions.

8. A fitting-detection connector according to claim 6, wherein said buffer spring portion includes a pair of inner vertical portion extending upwards from the inner end of a contact portion to be in contact with the detection terminals, a pair of horizontal portions outwardly extending in parallel to the contact portions from the vertical portions, a pair of outer vertical portions extending from the outer ends of said horizontal portions to a pair of abutting portions in parallel to said horizontal portions, said abutting portions being integral to said intrusion protrusions.

9. A fitting-detection connector according to claim 1, further comprising a resilient plate protruding from the lower end of said resilient locking arm whereby said detection terminal is prevented from being deformed.

10. A fitting-detection connector according to claim 2, further comprising a resilient plate protruding from the lower end of said resilient locking arm whereby said detection terminal is prevented from being deformed.

11. A fitting-detection connector according to claim 3, further comprising a resilient plate protruding from the lower end of said resilient locking arm whereby said detection terminal is prevented from being deformed.

12. A fitting-detection connector according to claim 4, further comprising a resilient plate protruding from the lower end of said resilient locking arm whereby said detection terminal is prevented from being deformed.

13. A fitting-detection connector according to claims 9, wherein the resilient plate extends slightly outwardly from the outer ends of the detection terminals.

14. A fitting-detection connector according to claim 10, wherein the resilient plate extends slightly outwardly from the outer ends of the detection terminals.

15. A fitting-detection connector according to claim 11, wherein the resilient plate extends slightly outwardly from the outer ends of the detection terminals.

16. A fitting-detection connector according to claim 12, wherein the resilient plate extends slightly outwardly from the outer ends of the detection terminals.

* * * * *